US007318292B2

(12) United States Patent
Helbling et al.

(10) Patent No.: US 7,318,292 B2
(45) Date of Patent: Jan. 15, 2008

(54) METHOD AND DEVICE FOR ATTENUATING THE MOTION OF HYDRAULIC CYLINDERS OF MOBILE WORK MACHINERY

(75) Inventors: Frank Helbling, Weinstrasse (DE); Gerhard Kossmann, Kreuzstrasse (DE)

(73) Assignee: Liebherr-France SAS, Colmar Cedex (FR)

( * ) Notice: Subject to any disclaimer, the term of this patent is extended or adjusted under 35 U.S.C. 154(b) by 309 days.

(21) Appl. No.: 10/729,789

(22) Filed: Dec. 5, 2003

(65) Prior Publication Data

US 2004/0128868 A1 Jul. 8, 2004

(30) Foreign Application Priority Data

Dec. 5, 2002 (DE) ..... 102 56 923

(51) Int. Cl.
*E02F 5/02* (2006.01)
*G05F 1/02* (2006.01)

(52) U.S. Cl. ..... 37/348; 91/393

(58) Field of Classification Search ..... 37/348; 91/392, 393

See application file for complete search history.

(56) References Cited

U.S. PATENT DOCUMENTS

| | | | | |
|---|---|---|---|---|
| 4,358,989 A | | 11/1982 | Tordenmalm | |
| 4,896,582 A | | 1/1990 | Tordenmalm et al. | |
| 5,261,234 A | * | 11/1993 | Holloway et al. | 60/462 |
| 5,431,086 A | * | 7/1995 | Morita et al. | 91/361 |
| 5,727,387 A | * | 3/1998 | Hosseini et al. | 60/327 |

FOREIGN PATENT DOCUMENTS

| | | |
|---|---|---|
| DE | 4201464 | 7/1993 |
| DE | 19801338 | 6/1999 |
| DE | 19915260 | 10/2000 |
| DE | 10122297 | 6/2002 |
| EP | 0879969 | 11/1998 |
| GB | 1382057 | 1/1975 |

* cited by examiner

*Primary Examiner*—Thomas A Beach
(74) *Attorney, Agent, or Firm*—Dilworth & Barrese, LLP

(57) ABSTRACT

The present invention relates to a method for attenuating the motion of hydraulic cylinders of mobile work machinery, in particular of hydraulic excavators, in which prior to the hydraulic cylinder reaching one of the limits of travel, its motion speed is reduced, and the hydraulic cylinder is moved to the respective limit of travel at reduced speed; wherein for the purpose of reducing the speed, the inflow to, and/or the outflow from, the hydraulic cylinder are/is throttled by a flow control device. According to the invention, the method is characterized by, prior to the respective limit of travel being reached, the motion speed of the hydraulic cylinder is registered, and the point in time when throttling commences is changed depending on the registered motion speed. Furthermore, the present invention relates to a device for attenuating the motion of hydraulic cylinders of mobile work machinery, in particular of hydraulic excavators, a position registering device for registering a preliminary limit position of the hydraulic cylinder, a control device for throttling the inflow and/or outflow of the hydraulic cylinder, and a control device for controlling the flow control device when the preliminary limit position is reached. According the invention, the device has a speed registering device for registering the motion speed of the hydraulic cylinder when the preliminary limit position is reached, and the control device has a delay device for delaying driving the flow control device, depending on the recorded motion speed.

22 Claims, 5 Drawing Sheets

METHOD AND DEVICE FOR ATTENUATING THE MOTION OF HYDRAULIC CYLINDERS OF MOBILE WORK MACHINERY

BACKGROUND OF THE INVENTION

The present invention relates to a method as well as to a device for attenuating the motion of hydraulic cylinders of mobile work machinery, in particular of hydraulic excavators, wherein, by means of a position registering device, reaching of a preliminary limit position of the hydraulic cylinder is registered; prior to the limits of travel of the hydraulic cylinder being reached, its motion speed is reduced; and the hydraulic cylinder is moved to the respective limit of travel only at reduced speed. To this effect a flow control device for throttling the inflow to, and/or the outflow from, the hydraulic cylinder is provided, with said throttling being correspondingly driven by a control device when the preliminary limit position is reached, so as to throttle the flow quantity which flows into, or out of, said hydraulic cylinder.

The motion attenuation or limit of travel switch-off of hydraulic cylinders ensures that the speed of the hydraulic cylinders is reduced shortly before the mechanical limit stop is reached, in order to prevent excessive mechanical loads acting on the steel components, due to inertia forces resulting from the abrupt delay, and in order to increase the level of work comfort. Hydraulic solutions as well as electrical switch-off devices have already been proposed for such motion attenuation.

FIG. 7 shows a hydraulic solution. As shown in said Figure, hydraulic cylinders of earth-moving machinery such as hydraulic excavators and the like are regularly driven by way of a hydraulic pump 1 and a directional control valve 4 arranged downstream of said hydraulic pump 1. In the limit region of the piston and the rod, the hydraulic cylinder 10 comprises geometric changes 13 which cause a pressure buildup of the returning fluid at the time of entry into the changed geometry 12 of the cylinder housing.

The speed of the cylinder is determined by way of the flow rate of the hydraulic pump 1 in the inflow to the cylinder. An attenuation effect is generated only if the quantity in the inflow to the cylinder is reduced. In this arrangement, a reduction can only be achieved in that either the regulator R of the pump 1 or a pressure relief valve 7, which forms part of the hydraulic circuit, responds. In this arrangement, a response of the pump regulator or of the pressure relief valve is achieved by the inflow pressure, which means that the banking-up pressure on the outflow side has to increase in line with the transmission ratio of the hydraulic cylinder. Depending on the size of the machine, the pressure regulator of the pump, or the pressure relief valve respectively, responds at between 300 and 350 bar pressure, so that a banking-up pressure of 600 to 700 bar is required on the inflow side of the hydraulic cylinder.

The banking-up pressure is achieved via throttling at the annular clearance and via special throttle cross-sections, wherein the throttle effect at the annular clearance greatly depends on manufacturing tolerances and the viscosity of the fluid. Due to these deviations of parameters relating to the geometry and the fluid, there is a good likelihood that either the banking-up pressure is insufficient to activate the control devices, or that the banking-up pressure increases to such an extent that the integrity of the cylinder housing is endangered.

Due to these shortcomings, electrical switching off of the inflow and outflow has been proposed. In systems with electro-hydraulic pilot control, electrical switching off has been used in which one limit switch is provided for each movement direction of the cylinder. Shortly before the cylinder reaches its limit of travel, a respective limit switch is overtravelled, with the signal of said limit switch prompting the control device to switch the respective directional control valve off. This results in the motion being decelerated, depending on the switching speed of the directional control valve.

However, with this solution, stopping regularly takes place either too early or too late. This means that either the kinematics are not completely utilised, or that the mechanical limit stop of the hydraulic cylinder is still reached at excessive speed. Furthermore, during uncontrolled switching off, pressure peaks occur on the outflow side, while the inflow side is filled incompletely, with both of these occurrences leading to increased loads on the lines and hydraulic components.

SUMMARY OF INVENTION

It is thus the object of the present invention to create an improved method and an improved device for attenuating the motion of hydraulic cylinders of the type described in the introduction, to avoid the disadvantages of the state of the art, and to advantageously improve said state of the art.

Preferably, driving against the mechanical limit stop at excessive speed is reliably prevented, while the kinematics of the hydraulic cylinder are nevertheless used to the full extent.

According to the invention, this object is met by a method as well as a device described herein. Preferred embodiments of the invention are also described herein.

Thus, the invention provides for a speed registering device which registers the motion speed of the hydraulic cylinder before the respective limit of travel has been reached. The control device which drives the flow control device for throttling the inflow or outflow comprises a delay device by means of which the point in time when throttling commences is changed depending on the motion speed registered.

Thus, depending on the registered motion speed of the hydraulic cylinder, the flow control device is activated earlier or later so that motion attenuation, and therefore speed reduction, of the hydraulic cylinder commences earlier or later. Motion attenuation can in particular be matched to the motion speed, such that on the one hand the mechanical limit stop is reached, while on the other hand reaching the end stop takes place only at the desired minimum speed.

In order to match motion attenuation to the speed registered, it would in principle be possible to alter the throttling speed of the flow line, i.e. to alter the speed at which the flow quantity is slowed down. However, to ensure simple control, an improvement of the invention preferably provides for the throttling speed of the flow control device to be preset irrespective of the registered motion speed of the hydraulic cylinder. In other words, matching of the motion attenuation is achieved solely in that the point in time when throttling commences, i.e. the point in time when the flow control device is activated, is moved in time, depending on the registered speed. Though, if several flow control devices are used, it is quite possible to move in different ways the points in time when the controls are activated, so that, overall, different attenuation characteristics result. However, it is also possible to keep the throttling speed the same for each of the controls.

Expediently, commencement of attenuation is delayed with reduced motion speed of the hydraulic cylinder, i.e. commencement of attenuation starts later.

Basically, matching to the motion speed the point in time when attenuation commences can take place in several ways. However, to keep the control arrangement simple, in an improvement of the invention, the control device is designed such that a fixed initial point in time is always preset if the registered motion speed is greater than, or equal to, a preset limit speed; in other words, if the preliminary limit position registered by the piston-position registering device is overtravelled at a limit speed or a speed which is higher than said limit speed. In this case, attenuation is initiated at once. However, if the motion speed registered in the preliminary limit position is below the limit speed, the point in time when attenuation commences is delayed by a certain period. The period of time by which the point in time when attenuation commences, or the point in time when the flow control device is activated, is delayed, can be variably determined by the control device. Preferably, the control device changes the period of time by which attenuation is shifted, proportionally in relation to the speed registered at the time the preliminary limit position is reached.

In an improvement of the invention, the speed registering device can comprise two limit signal transmitters, arranged in tandem, which limit signal transmitters are overtravelled shortly before the piston reaches its limit position, with the speed registering device further comprising a time registering device which registers the period of time between the signals of the two limit signal transmitters. The signal of the time registering device, which signal reflects said period of time between the signals of the two limit signals, forms the speed signal which provides the basis for the control device to drive the flow control device.

In a comparator device of the control device, the period of time registered, whose duration reflects overtravel of the two limit signal transmitters which are arranged in tandem, is then compared with a preset period of time. If the difference is negative, i.e. if the registered time is less than the preset time, the control device determines the fixed earliest possible point in time when attenuation commences. If the difference is positive, i.e. if the registered time exceeds the preset time, the differential amount is used as a basis for delaying commencement of attenuation. In particular, the point in time when attenuation commences can be delayed by the amount of the difference determined.

In principle, the speed registering device, or its limit signal transmitters respectively, can be arranged at any location and can be associated with the hydraulic cylinder. In order to create a simple arrangement which requires only one pair of limit signal transmitters for both limit positions, first and second markings can be provided at the piston rod of the hydraulic cylinder and/or at a detection transmitter coupled therewith, with said first and second markings corresponding to one of the two limit positions or preliminary limit positions of the piston. Both markings can be registered by a correspondingly arranged pair of limit signal transmitters. Accordingly, only one registering device is provided for registering both limit positions, and only one registering device for registering the speed when the two limit positions are reached.

Preferably, the registering devices can be integrated in the hydraulic cylinder, in particular arranged in the region of the collar of the hydraulic cylinder, through which collar the piston rod exits.

According to a particularly advantageous embodiment of the invention, a detection transmitter can be provided which is separate from the hydraulic cylinder but which is coupled with said hydraulic cylinder, with said detection transmitter moving according to the motion of the hydraulic cylinder. In particular, a rotatory disk can be provided in this arrangement, with said rotatory disk comprising two markings of the type mentioned above. The position of the markings can be registered by corresponding limit signal transmitters.

BRIEF DESCRIPTION OF THE DRAWINGS

Below, the invention is explained in detail with reference to preferred embodiments and associated drawings. The drawings show the following.

DESCRIPTION OF THE PREFERRED EMBODIMENTS

Figure 1:
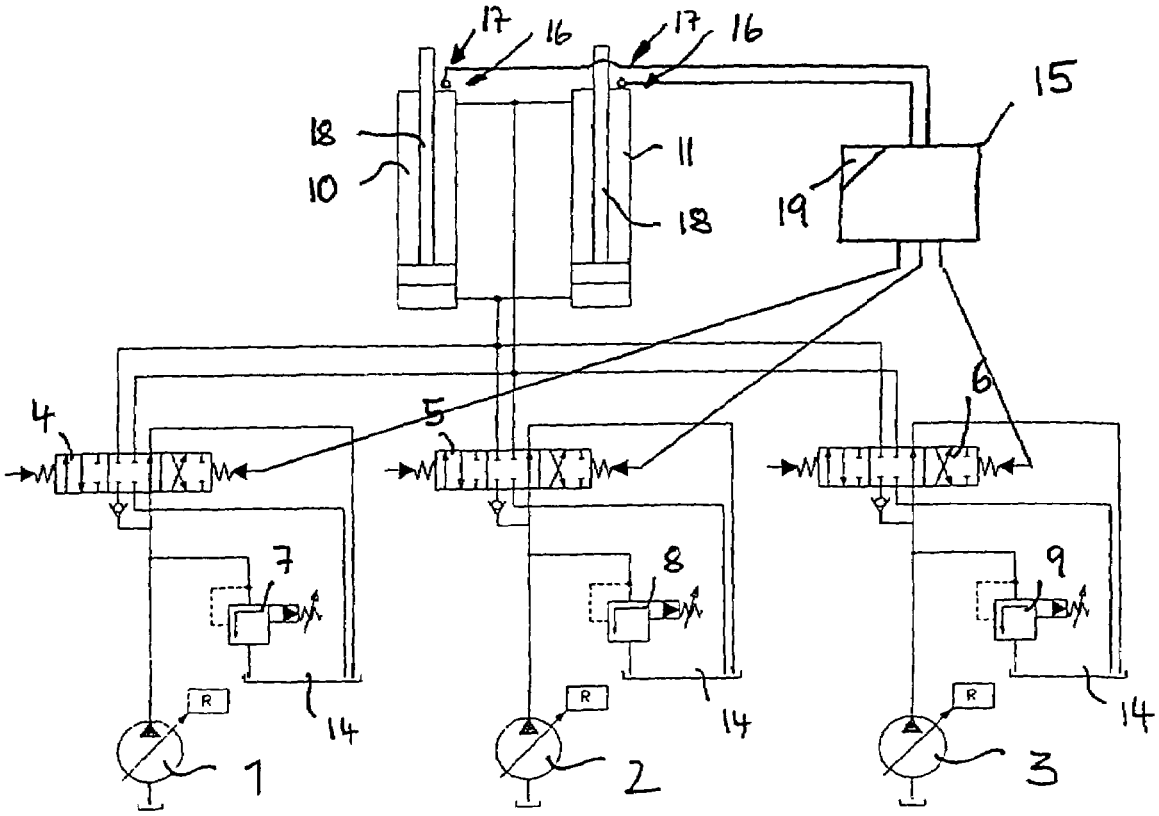
FIG. 1 a diagrammatic representation of a hydraulic drive system for two hydraulic cylinders of a hydraulic excavator comprising a device for attenuating the motion according to an advantageous embodiment of the present invention, wherein the drive system shown is a system comprising three pumps.

As shown in FIG. 1, the hydraulic cylinders 10 and 11, which for example can be the lifting cylinders of a hydraulic excavator, are driven by a hydraulic drive which comprises three hydraulic pumps 1, 2 and 3, each of which can be regulated by way of a regulator R. The three hydraulic pumps 1, 2 and 3 are connected to the hydraulic cylinders 10 and 11, each by way of a directional control valve 4, 5 and 6, with said hydraulic cylinders 10 and 11 also being switched in parallel in relation to each other. By means of the directional control valves 4, 5 and 6, the inflows to, and the outflows from, the hydraulic cylinders 10 and 11 can be cut off and shut off from the respective pumps 1, 2 and 3 in a way which is known per se, or a flow connection to the pump can be established, wherein the direction of flow is reversible so that the hydraulic cylinders can be extended and retracted. Upstream of the directional control valves 4, 5 and 6, the pressure lines emanating from the pumps 1, 2 and 3 comprise pressure relief valves 7, 8 and 9 by way of which the hydraulic fluid can be drained into the tank 14. By way of corresponding lines, the directional control valves 4, 5 and 6 are also connected to the tank 14 in order to lead the fluid which returns from the hydraulic cylinders into the tank, both in the shut-off position and in the corresponding switching position.

The directional control valves 4, 5 and 6 are driven by an electronic control device 15 in order to control the movement of the hydraulic cylinders 10 and 11.

The movement of the hydraulic cylinders 10 and 11 is monitored by a position registering device 17 which shows when the piston rod approaches its two limit positions, in particular when a preliminary limit position has been reached. Furthermore, a speed registering device 16 registers the speed of the piston rod of the hydraulic cylinders 10 and 11 when said hydraulic cylinders 10 and 11 reach said preliminary limit position.

Figure 3:
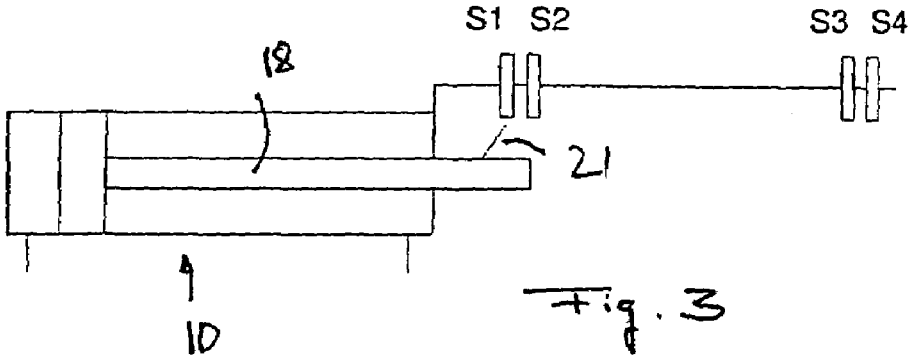
FIG. 3 the arrangement of the limit signal transmitters for registering a preliminary limit position and speed of the piston of the hydraulic cylinder according to one embodiment of the invention in which four limit signal transmitters are provided which register markings at the piston rod.

Registering the speed and registering the preliminary limit position can take place in various ways. FIG. 3 shows a speed registering device 16 in its simplest form. In this arrangement, registering the speed takes place in each of the preliminary limit positions of the pistons of the hydraulic cylinders by means of two limit switches $S_1$ and $S_2$, and $S_3$ and $S_4$ respectively. The piston rod 18 shows a marking which is registered by the limit switches $S_1$ to $S_4$ when the piston rod is moved past it. The limit switches can be mechanical switches or induction transducers. A time registering device 19 in the control device 15 is associated with the limit switches $S_1$ to $S_4$, with said time registering device 19 determining the period of time it takes for the limit switches $S_1$ and $S_2$ or $S_3$ and $S_4$ respectively to be overtravelled, with said limit switches being arranged in tandem. The time which it takes for a pair of limit switches to be overtravelled is a measure of the piston speed when the preliminary limit position is reached.

Figure 4:
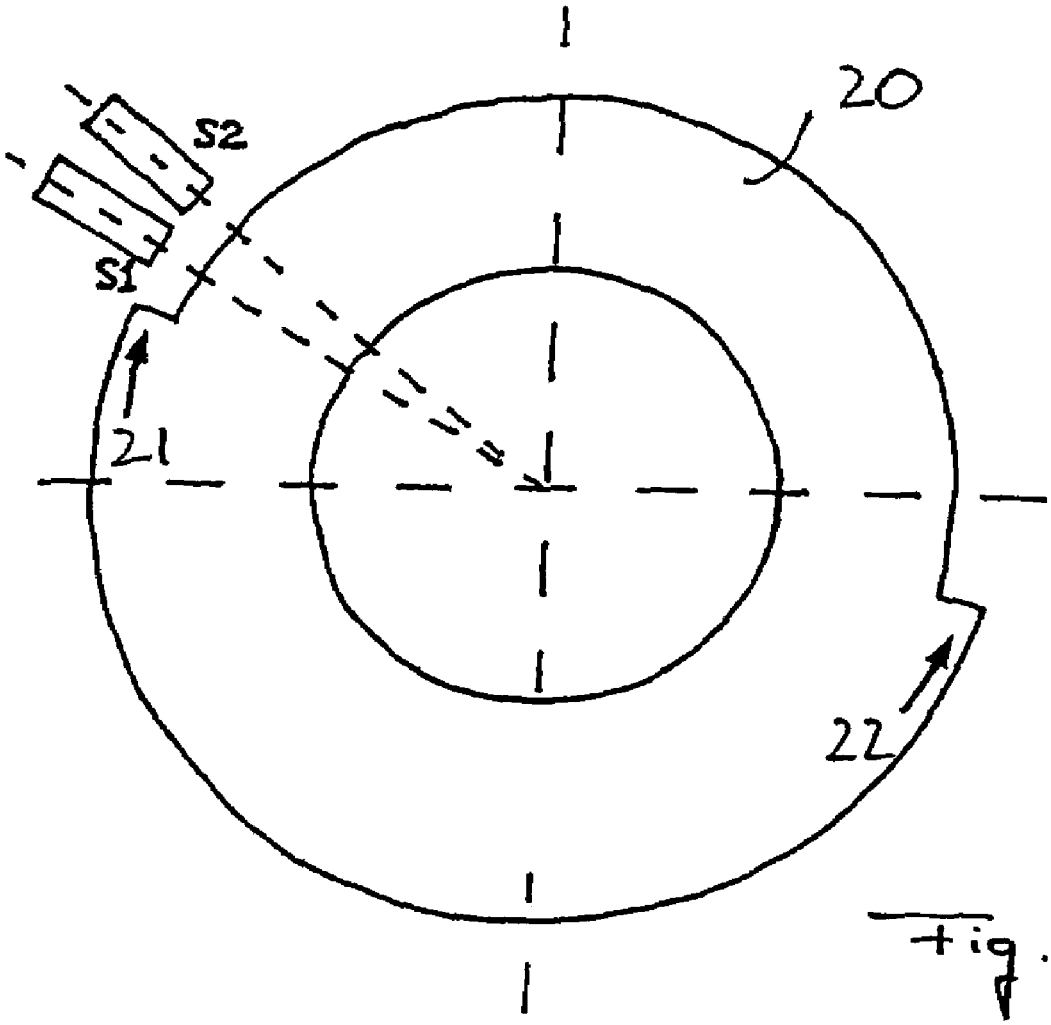
FIG. 4 a diagrammatic representation of a detection disk which is coupled to the piston rod of the hydraulic cylinder, as well as the associated arrangement of the limit signal transmitters of a registering device for registering the preliminary limit position and the speed of the hydraulic cylinder for both movement directions.

FIG. 4 shows a simplified embodiment of a speed registering device 16. In this arrangement, the limit switches $S_1$ and $S_2$ are not arranged directly on the hydraulic cylinder, i.e. they are not directly associated with the piston rod 18, but instead, are arranged on the centre of motion of corresponding equipment parts which are moved in relation to each other by the hydraulic cylinders 10 and 11. For example, the rotary detection disk 20 can be connected to a moving part, e.g. on the dipper ladle it can be connected to the bearing block of a hydraulic excavator, or it can be formed by part of said bearing block. The limit switches in the form of induction transducers $S_1$ and $S_2$ can be connected to the counter part, e.g. to the shaft of the push shovel of the hydraulic excavator. The markings 21, 22 have been provided on the detection disk 20 such that they reach the limit switches $S_1$ and $S_2$ whenever the hydraulic cylinder reaches one of its preliminary limit positions.

Figure 5:
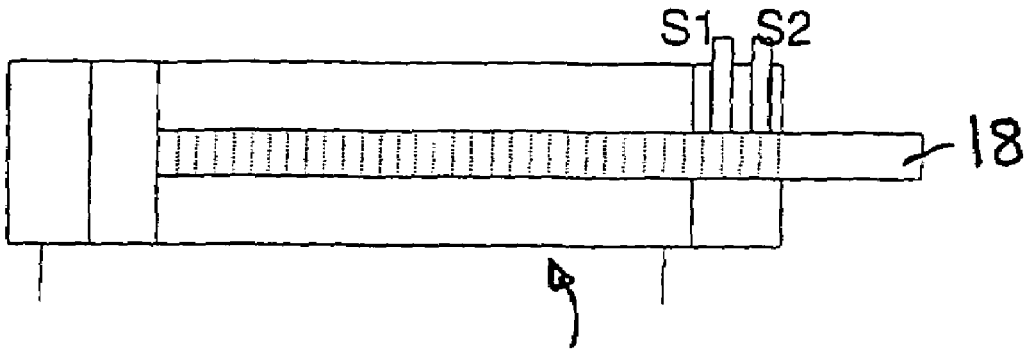
FIG. 5 a diagrammatic representation of a device, integrated in the hydraulic cylinder, for registering the piston position and the piston speed.

FIG. 5 shows a further preferred embodiment of a speed registering device 16. In this embodiment, piston travel is registered along the complete distance travelled by the piston, by way of markings on the cylinder rod or piston rod 18 and corresponding limit switches or sensors $S_1$ and $S_2$. The sensors $S_1$ and $S_2$ are in the unpressurised region of the piston rod bearing. Advantageously, such a relative sensing system comprises a reference zero-point which is overtravelled at least once during each startup of the machine.

Figure 6:
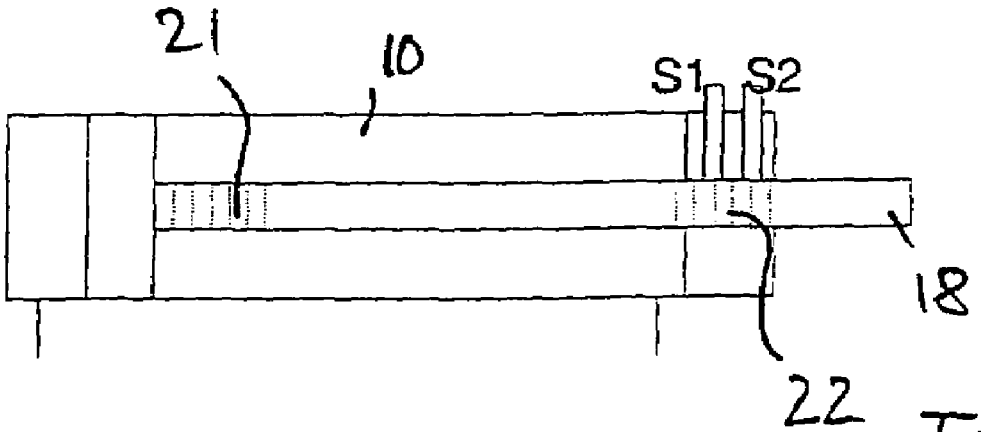
FIG. 6 a diagrammatic representation of a device, integrated in the hydraulic cylinder, for registering the preliminary limit position and the speed of the piston of the hydraulic cylinder according to a further embodiment of the invention.
Figure 7:
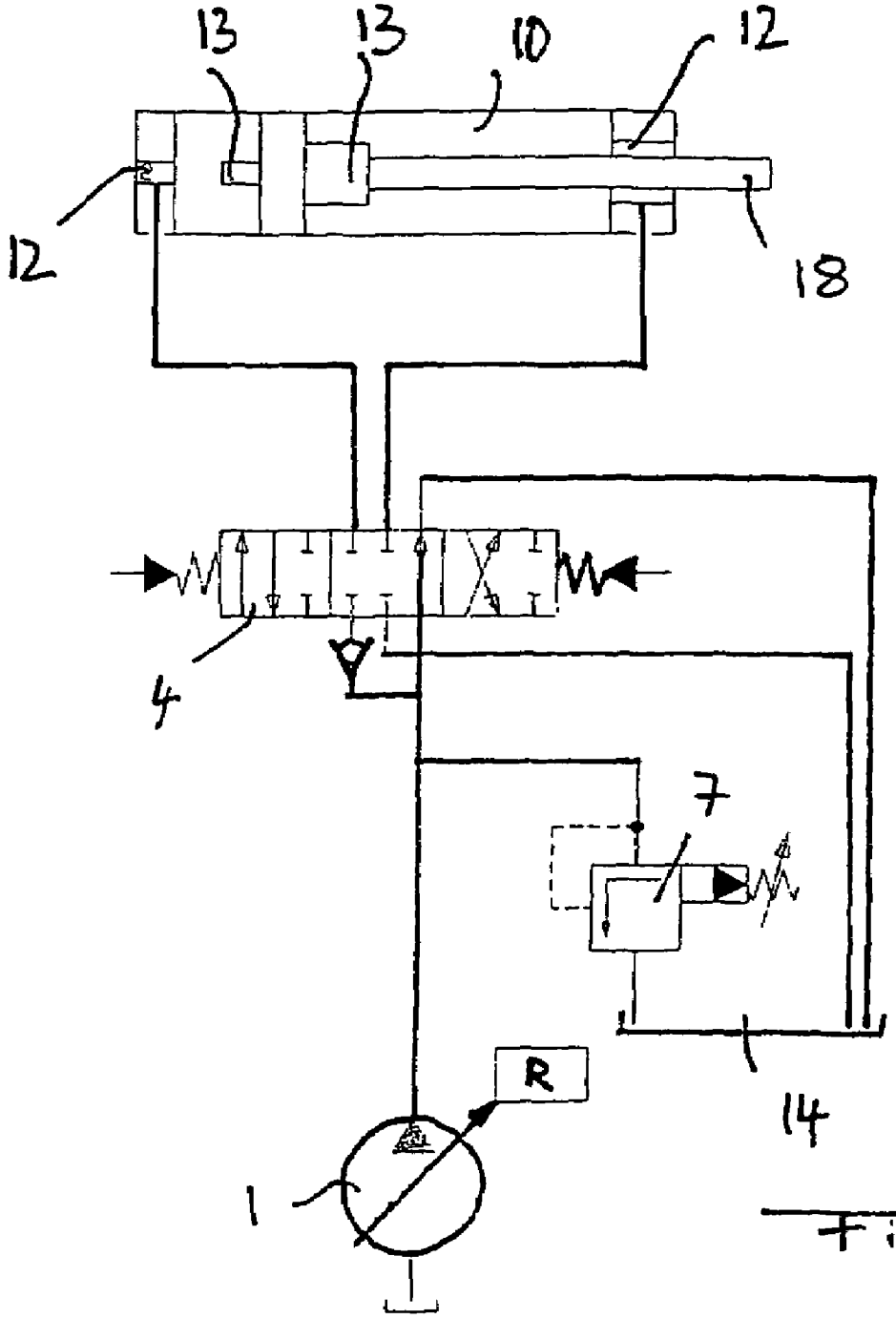
FIG. 7 a diagrammatic representation of a hydraulic single-pump drive of a hydraulic cylinder with hydraulic motion attenuation according to the state of the art.

Compared to this, the design of the position and speed registering devices 16 and 17 shown in FIG. 6 is preferred for the present motion attenuation. Travel of the piston rod 18 is only registered in the region of the two limit positions of travel—this is perfectly adequate for hydraulic cylinders where only motion attenuation according to the invention is to take place. Again, the limit switches $S_1$ and $S_2$ are integrated in the hydraulic cylinder in the region of the piston rod bearing, with said limit switches $S_1$ and $S_2$ registering markings on the piston rod 18, which markings are provided in the limit regions of said piston rod 18. If the markings 21 or 22 reach the limit switches or the limit signal transmitters $S_1$ and $S_2$, they transmit a signal so that, in the way previously described, it can be shown when the preliminary position of the piston is reached, and the speed of the piston at that time can be registered or determined.

Figure 2:
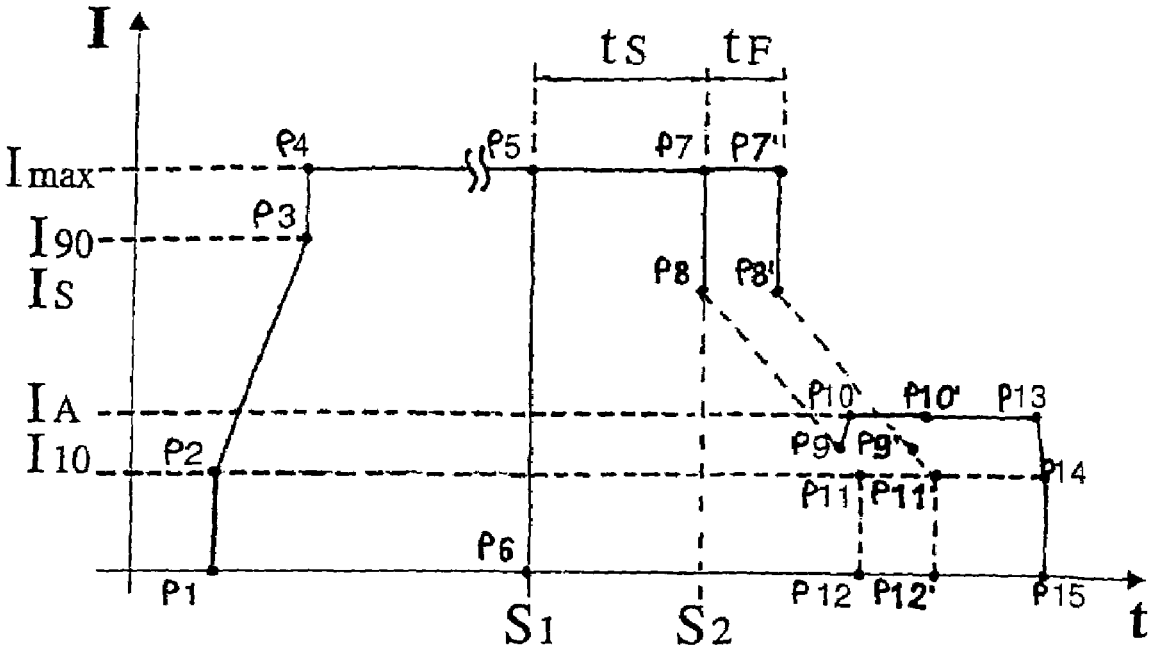
FIG. 2 a flow time diagram which shows the curve of the drive current for the directional control valves of the hydraulic drive from FIG. 1 for achieving the desired motion attenuation.

The control device 15 which is shown in FIG. 1 activates the directional control valves 4, 5 and 6 when the preliminary position is reached, depending on the speed registered at the time, as follows:

As shown in FIG. 2, movement of the hydraulic cylinders 10 and 11 is initiated by driving the directional control valves 4, 5 and 6 at point P1. The drive current is first increased to a 10% value such as 10 so that commencement of motion of the hydraulic cylinders at point 2 can be assumed. Pressure build-up and acceleration of the hydraulic cylinders 10 and 11 is along the control ramp between the points P2 and P3. The hydraulic cylinders reach their maximum speed with 90% drive current $I_{90}$, which is reached at point P3 of the diagram in FIG. 2. From this, there is a transition to maximum current Imax at point P4 so that the hydraulic pistons travel at full speed.

If the piston is accordingly moved to one of its limit positions, then at first the first limit signal transmitter $S_1$ in the direction of travel is overtravelled. In the diagram at point P5 according to FIG. 2 the hydraulic cylinder still moves at full speed, wherein the first limit signal transmitter $S_1$ issues its signal. At this point, depending on the equipment component, a control piston of one of the directional control valves 4, or several control pistons of several directional control valves 4 and 5, is/are abruptly shut off so that the corresponding drive current for these directional control valves suddenly drops from point P5 to point P6, i.e. to zero, with the control pistons following the current in accordance with their dynamic characteristics.

The remaining control pistons continue to be driven at first with full drive current Imax, until the second limit signal transmitter $S_2$ is also overtravelled and transmits its corresponding signal. The time registering device 19 of the control device 15 determines the time $t_K$ which it took for both limit signal transmitters $S_1$ and $S_2$ to be overtravelled. A comparator and subtractor device 23 in the control device 15 compares the registered value $t_K$ of the period of time, with said value $t_K$ being a measure of the speed of the hydraulic cylinder, to a preset value $t_S$. If the registered time $t_K$ is smaller than or equal to the value $t_S$, then the attenuation effect takes place along the line between the points P7, P8, P9, P10, P11, P12. This means that the registered piston speed was higher than or equal to a limit speed. The attenuation process is initiated at once.

However, if the recorded time $t_K$ is larger than the preset value $t_S$, then attenuation is offset in time, namely along the line between the points P7', P8', P9', P10', P11' and P12'. During this process, the control device 15 selects the time offset $t_F$ proportionally to the time excess of $t_S$, i.e. proportional to the amount by which the registered time $t_K$ exceeds the preset time $t_S$.

The non-delayed attenuation process along the line between points P7 and P12, and the time-delayed attenuation process along the line between points P7' and P12' can be described as follows:

First, the drive current for the remaining directional control valves 6 to n is reduced to the level-change value $I_s$, i.e. for the directional control valves whose drive current was not immediately reduced at the time when the first limit signal transmitter $S_1$ was overtravelled. As a result of the jump, the control pistons of the directional control valves are abruptly brought to a position from which a deceleration effect occurs on the outflow side of the hydraulic cylinders 10 and 11.

Deceleration then takes place along the attenuation ramp from point P8 to point P9, and from point P8' to point P9' respectively. Depending on the number of the remaining control pistons, a piston travels further along the attenuation ramp to points P11 and P11' respectively, where the piston is then switched off, i.e. the current is shut down to zero, as indicated by points P12 and P12' respectively.

The remaining control piston of the one directional control valve is driven along a control ramp from point P9 to point P10 and P9' and P10' respectively, where said control piston then attains the run-down current $I_A$ at point P10. With the run-down current, reaching the end position at full cylinder power becomes possible.

Gradual shutoff is initiated at point P13 by releasing the manual control transmitter. The current travels along the level-change ramp from point P13 to point P14 and is then switched off along the line from point P14 to point P15.

It is understood that the attenuation process in the opposite direction takes place according to the same model, with detection and direction recognition taking place in the opposite direction.

If instead of the three pumps 1, 2 and 3 only one pump is used for supplying the hydraulic cylinders, it is understood that when the first limit signal transmitter $S_1$ is overtravelled, the control piston of the respective directional control valve is not switched off yet. The overall process then takes place in a speed-dependent way from the point of overtravelling the second limit signal transmitter $S_2$. In principle, n pumps can be used.

The invention claimed is:

1. A method for attenuating the motion of a hydraulic cylinder (10, 11) of mobile work machinery comprising the steps of:

a) registering the speed of the hydraulic cylinder (10, 11) prior to its reaching a respective limit of travel and determining whether the speed exceeds a predetermined value;

b) reducing the speed of the hydraulic cylinder (10, 11) if the speed exceeds the predetermined value prior to reaching one of the limits of travel of the hydraulic cylinder (10, 11), and c) moving the hydraulic cylinder (10, 11) to the respective limit of travel at reduced speed, wherein said step (c) of reducing the speed is accomplished by the steps of (i) throttling the inflow to, and/or the outflow from, the hydraulic cylinder (10, 11) by a flow control device (4, 5, 6), and ii) changing the point in time (P7, P7') when throttling commences depending on the registered speed.

2. The method according to claim 1, wherein the throttling speed of the flow control device (4, 5, 6) is preset irrespective of the registered motion speed of the hydraulic cylinder (10, 11).

3. The method according to claim 1, wherein commencement of attenuation (P7, P7') is delayed with reduced registered motion speed.

4. The method according to claim 1, wherein a fixed initial point in time (P7) is always preset if the registered motion speed is greater than, or equal to, a preset limit speed, and, if the motion speed registered is below the limit speed, the point in time (P7') is delayed in relation to the fixed point in time (P7) by a period of time ($t_F$).

5. The method according to claim 4, wherein the period of time ($t_F$) is changed depending on the registered motion speed.

6. The method according to claim 1, wherein prior to reaching the respective limits of travel, two limit signal transmitters ($S_1$, $S_2$) which are arranged in tandem, are overtravelled; the period of time ($t_K$) between overtravel of the two limit signal transmitters ($S_1$, $S_2$) is registered, from the registered period of time ($t_K$) and a preset period of time ($t_S$) a time difference (□t) is determined; and according to the time difference (□t), a delay ($t_F$) of the point in time (P7') when attenuation commences is determined.

7. The method according to claim 1 further providing an attenuating device for attenuating the motion of a hydraulic cylinder of mobile work machinery, said attenuating device comprising a position registering device (17) for registering a preliminary limit position of the hydraulic cylinder (10, 11), a control device (4, 5, 6) for throttling at least one of inflow to and outflow from the hydraulic cylinder (10, 11), a control device (15) for controlling the flow control device (4, 5, 6) when the preliminary limit position is reached, a speed registering device (16) for registering the motion speed of the hydraulic cylinder when the preliminary limit position is reached, and the control device (15) comprises a delay device for delaying driving the flow control device (4, 5, 6), depending on the registered motion speed.

8. The method according to claim 7 providing the attenuating device, wherein the speed registering device (16) comprises two limit signal transmitters ($S_1$, $S_2$) arranged in tandem, and a time registering device (19) is provided which registers the period of time ($t_K$) between the signals of the two limit signal transmitters ($S_1$, $S_2$).

9. The method according to claim 8 providing the attenuating device, wherein one of the limit signal transmitters ($S_1$, $S_2$) at the same time forms the position registering device (17).

10. The method according to claim 7 providing the attenuating device, wherein first and second markings (21, 22) are provided at least one of the piston rod (18) of the hydraulic cylinder (10, 11) and a detection transmitter (20) coupled therewith, with said first and second markings (21, 22) corresponding to the two preliminary limit positions, and both markings being able to be registered by at least one of the position registering device (17) and speed registering device (16).

11. The method according to claim 7 providing the attenuating device, wherein the speed registering device (16) is integrated in the hydraulic cylinder (10, 11).

12. The method according to claim 7 providing the attenuating device, wherein the speed registering device (16) is arranged to be separate from the hydraulic cylinder (10, 11) and is associated with a detection transmitter (20).

13. The method according to claim 7 providing the attenuating device, wherein the control device (15) comprises a comparator device (23) for comparing the registered period of time ($t_K$) with a preset period of time ($t_s$) and forming the difference between the two periods of time ($t_K$, $t_s$), and the delay device comprises a delay transmitter which presets the delay ($t_F$) at which the flow control device (4, 5, 6) is driven, with such presetting depending on the determined difference.

14. The method according to claim 7 providing the attenuating device, wherein the position registering device (17) is associated with a hinge point of two components of the motion train which is driven by the hydraulic cylinder (10, 11), with said position registering device (17) registering the position of the two components in relation to each other.

15. The method according to claim 8 providing the attenuating device, wherein first and second markings (21, 22) are provided at least one of the piston rod (18) of the hydraulic cylinder (10, 11) and a detection transmitter (20) coupled therewith, with said first and second markings (21, 22) corresponding to the two preliminary limit positions, and both markings being able to be registered by at least one of the position registering device (17) and speed registering device (16).

16. The method according to claim 9 providing the attenuating device, wherein first and second markings (21, 22) are provided at least one of the piston rod (18) of the hydraulic cylinder (10, 11) and a detection transmitter (20) coupled therewith, with said first and second markings (21, 22) corresponding to the two preliminary limit positions, and both markings being able to be registered by at least one of the position registering device (17) and speed registering device (16).

17. The method according to claim 8 providing the attenuating device, wherein the control device (15) comprises a comparator device (23) for comparing the registered period of time ($t_k$) with a preset period of time ($t_s$) and forming the difference between the two periods of time ($t_K$, $t_s$), and the delay device comprises a delay transmitter which presets the delay ($t_F$) at which the flow control device (4, 5, 6) is driven, with such presetting depending on the determined difference.

18. The method according to claim 9 providing the attenuating device, wherein the control device (15) comprises a comparator device (23) for comparing the registered period of time ($t_K$) with a preset period of time ($t_s$) and forming the difference between the two periods of time ($t_K$, $t_s$), and the delay device comprises a delay transmitter which presets the delay ($t_F$) at which the flow control device (4, 5, 6) is driven, with such presetting depending on the determined difference.

19. The method according to claim 10 providing the attenuating device, wherein the control device (15) comprises a comparator device (23) for comparing the registered period of time ($t_K$) with a preset period of time ($t_s$) and forming the difference between the two periods of time ($t_K$, $t_s$), and the delay device comprises a delay transmitter which presets the delay ($t_F$) at which the flow control device (4, 5, 6) is driven, with such presetting depending on the determined difference.

20. The method according to claim 15 providing the attenuating device, wherein the control device (15) comprises a comparator device (23) for comparing the registered period of time ($t_K$) with a preset period of time ($t_s$) and forming the difference between the two periods of time ($t_K$, $t_s$), and the delay device comprises a delay transmitter which presets the delay ($t_F$) at which the flow control device (4, 5, 6) is driven, with such presetting depending on the determined difference.

21. The method according to claim 5, wherein the period of time ($t_F$) is selected proportionally in relation to the registered motion speed.

22. The method according to claim 13 providing the attenuating device, wherein said presetting is proportional to said determined difference.

* * * * *